US012702216B2

(12) United States Patent
Dümmel

(10) Patent No.: US 12,702,216 B2
(45) Date of Patent: Aug. 11, 2026

(54) RECEPTACLE

(71) Applicant: GEKA GmbH, Bechhofen (DE)

(72) Inventor: Roland Dümmel, Bechhofen (DE)

(73) Assignee: GEKA GmbH, Bechhofen (DE)

( * ) Notice: Subject to any disclaimer, the term of this patent is extended or adjusted under 35 U.S.C. 154(b) by 143 days.

(21) Appl. No.: 18/282,464

(22) PCT Filed: Feb. 11, 2022

(86) PCT No.: PCT/EP2022/053344
§ 371 (c)(1),
(2) Date: Sep. 16, 2023

(87) PCT Pub. No.: WO2022/194460
PCT Pub. Date: Sep. 22, 2022

(65) Prior Publication Data

US 2024/0156236 A1 May 16, 2024

(30) Foreign Application Priority Data

Mar. 16, 2021 (EP) ..... 21162751

(51) Int. Cl.
*A45D 40/26* (2006.01)
*B65D 1/02* (2006.01)
(Continued)

(52) U.S. Cl.
CPC ..... *A45D 40/265* (2013.01); *B65D 1/0246* (2013.01); *B65D 51/32* (2013.01); *B65D 53/02* (2013.01); *B65D 2251/07* (2013.01)

(58) Field of Classification Search
CPC .. A45D 40/265; B65D 41/04; B65D 41/0407; B65D 41/0414; B65D 43/0231
See application file for complete search history.

(56) References Cited

U.S. PATENT DOCUMENTS

2006/0278661 A1 12/2006 Cooper et al.
2008/0230505 A1 9/2008 Kerman et al.
2009/0028627 A1* 1/2009 Gueret ..... A45D 34/046 401/122

FOREIGN PATENT DOCUMENTS

CN 101217898 A 7/2008
CN 101291872 A 10/2008
(Continued)

OTHER PUBLICATIONS

International Search Report issued Apr. 22, 2022 in corresponding International Application No. PCT/EP2022/053344.
(Continued)

*Primary Examiner* — David P Angwin
*Assistant Examiner* — Bradley S Oliver
(74) *Attorney, Agent, or Firm* — Spencer Fane, LLP

(57) ABSTRACT

A receptacle includes a container and a cap, the cap being attachable to the container for closure of the receptacle, and having a passage with an opening. The container has a neck for the passage along a longitudinal axis of the receptacle, and the opening has a non-circular shaped inner contour formed complementary to a non-circular shaped outer contour of the neck. An inner circumferential surface of the passage and an outer circumferential surface of the neck are formed so that a form-fitting engagement is generable by rotating the cap relative to the container around the longitudinal axis, and the inner circumferential surface of the passage and the outer circumferential surface of the neck are formed so that a press-fining engagement in a radial direction is generable by rotating the cap relative to the container around the longitudinal axis after the cap is in form-fining engagement with the neck.

23 Claims, 12 Drawing Sheets

(51) Int. Cl.
*B65D 51/32* (2006.01)
*B65D 53/02* (2006.01)

(56) References Cited

FOREIGN PATENT DOCUMENTS

| | | | | | |
|---|---|---|---|---|---|
| FR | 27904531 | A1 | | 9/2000 | |
| GB | 361885 | A | | 11/1931 | |
| GB | 2267484 | A | * | 12/1993 | ..... B65D 1/02 |
| GB | 2501061 | A | * | 10/2013 | ..... B65D 41/04 |

OTHER PUBLICATIONS

First Office Action received for Chinese Application No. 202280022032.4, mailed on June 19, 2025, 21 pages (English Translation Submitted).

* cited by examiner

RECEPTACLE

CROSS-REFERENCE TO RELATED APPLICATION

This application is a U.S. National Stage application of International Application No. PCT/EP20221053344, filed Feb. 11, 2022, which claims priority to European Application No. 21162751.8, filed Mar. 16, 2021, the contents of which are hereby incorporated by reference.

BACKGROUND

Technical Field

The disclosure concerns a receptacle comprising a container and a cap, the cap being repeatedly attachable to the container for closure of the receptacle.

Background Information

Receptacles of this kind are used for many applications including the packaging of beauty products such as mascara. For attaching the cap to the container, multiple systems are known, e.g., profiled threads, a bayonet lock, a swiveling cap in combination with snap on, a wire hanger as clip lock, an eccentric handle to compress a sealing, or a bistable snap cover.

SUMMARY

It has been determined that the systems mentioned above are complex in shape, are difficult to produce, or need more parts. Therefore, it has been determined that there is a need for a receptacle which enables attaching the cap to the container in a simple, fast and reliable manner.

This need is satisfied by a receptacle comprising a container and a cap, the cap being repeatedly attachable to the container for closure of the receptacle, the cap having a passage having an opening formed therein, the container having a neck for insertion into the passage via the opening of the cap along a longitudinal axis of the receptacle, wherein the opening of the cap has a non-circular shaped inner contour formed complementary to a non-circular shaped outer contour of the neck, wherein an inner circumferential surface of the passage and an outer circumferential surface of the neck are formed so that a form-fitting engagement in the axial direction is generable by rotating the cap relative to the container around the longitudinal axis, and wherein the inner circumferential surface of the passage and the outer circumferential surface of the neck are formed so that a press-fitting engagement in a radial direction between the inner circumferential surface of the passage and the outer circumferential surface of the neck is generable by rotating the cap relative to the container around the longitudinal axis after the cap is in form-fitting engagement with the neck.

The disclosure is based on the concept that the cap and the container are attached to each other by first generating a form-fitting engagement—e.g. similar to a thread—in the axial direction and then generating a press-fitting engagement which—different to a thread—is generated in a radial direction between the inner circumferential surface of the passage and the outer circumferential surface of the neck by rotating a non-circular section of the passage in the cap relative to a non-circular section of the neck of the container.

Embodiments of the receptacle are defined by the dependent claims and described in the following disclosure.

The non-circular shaped inner contour of the cap can extend along a subsection of the passage or along substantially the whole passage. Accordingly, the non-circular shaped outer contour of the neck can extend along a subsection of the neck or along substantially the whole neck.

According to an embodiment, the outer circumferential surface of the neck is formed as an outer circumferential surface of a twisted non-circular element: and the inner circumferential surface of the passage is correspondingly formed as an inner circumferential surface of a twisted non-circular pipe, in particular a twisted non-cylindrically shaped pipe that is twisted so that sections of this pipe in a plane perpendicular to the longitudinal axis are non-circular, so that the cap can be attached onto the neck of the container. In other words, the neck has non-circular shaped cross-sections with constant sizes along the longitudinal axis, but the orientation of the non-circular cross-sections changes constantly so that points of the surface that are equally distanced from the longitudinal axis of the neck are arranged along a helix.

According to a second aspect, a receptacle comprising a container and a cap is pro-vided, wherein the cap being repeatedly attachable to the container for closure of the receptacle, the cap having a passage having an opening formed therein, the container having a neck for insertion into the passage via the opening of the cap along a longitudinal axis of the receptacle, wherein the opening of the cap has a non-circular shaped inner contour formed complementary to a non-circular shaped outer contour of the neck, wherein an outer circumferential surface of the neck is formed as an outer circumferential surface of a twisted non-circular element;

and an inner circumferential surface of the passage is correspondingly formed as an inner circumferential surface of a twisted non-circular pipe so that the cap can be attached onto the neck of the container by rotating the cap relative to the container.

According to an embodiment, the non-circular contour of the neck and/or the passage has a symmetrical circumferential shape. The circumferential shape can be mirror-symmetrical, e.g., can have an oval shape. This allows the cap to attach onto the neck starting in two different angular positions. Alternatively, the circumferential shape can be rotationally symmetrical, e.g., can be shaped like a triangle with rounded edges. This simplifies attaching the cap to the neck because it allows the cap to be placed onto the neck in, e.g., three, different angular positions.

According to a further embodiment, the inner circumferential surface of the passage and the outer circumferential surface of the neck are formed and/or configured so that by rotating the cap relative to the container around the longitudinal axis, the cap is forced towards the container along the longitudinal axis. This allows the cap to be attached onto the neck of the container easily.

In order to generate a press-fitting engagement between the neck of the container and the cap in a radial direction, the inner circumferential surface of the passage can have multiple concave surfaces and the outer circumferential surface of the neck can have corresponding convex circumferential surfaces that allow jamming the cap onto the neck by rotating the cap relative to the neck of the container. In particular, this should be only possible in regular operation when the cap is fully attached onto the neck of the container.

Generally, in order to be able to fairly quickly attach the cap onto the container and detach the cap from the container, the outer circumferential surface of the neck can be formed as an outer circumferential surface of a non-circular element twisted by 360° or less and the inner circumferential surface of the passage can be correspondingly formed as an inner circumferential surface of a non-circular pipe twisted by 360° or less.

In order to create a quick lock function, i.e. in order to be able to quickly attach the cap onto the container and detach the cap from the container, the outer circumferential surface of the neck can be formed as an outer circumferential surface of a non-circular element twisted about 180° and the inner circumferential surface of the passage can be correspondingly formed as an inner circumferential surface of a non-circular pipe twisted about 180°, This allows to fully attach the cap onto the neck of the container by rotating the cap relatively to the neck by about half of a turn. The press-fitting engagement can be generable ley proceeding to rotate the cap relative to the neck by 5° to 20° after being fully attached onto the neck.

In order to have a smooth outer surface on the neck that can be cleaned easily, the contour of the neck along the longitudinal axis and/or the circumferential direction can be continuous.

Furthermore, an even smoother surface can be achieved if a pitch of the contour of the neck along the longitudinal axis and/or the circumferential direction is continuous. In particular, the contour of the neck along the longitudinal axis and/or the circumferential direction can be continuous in curvature and gradient. This creates a smooth and easy to clean surface.

In other words, the neck can have a continuous outer peripheral extent in a majority of sectional planes perpendicular to the longitudinal axis, in particular in all of its sectional planes. Furthermore, the outer circumference of the neck in these sectional planes can be formed by non-concentric sections.

Similarly, in order to be able to clean the inner circumferential surface of the passage of the cap more easily, the contour of the passage along the longitudinal axis and/or the circumferential direction can be continuous. Furthermore, for the reasons mentioned above, a pitch of the contour of the passage along the longitudinal axis and/or the circumferential direction can be continuous. In particular, the contour of the passage along the longitudinal axis and/or the circumferential direction can be continuous in curvature and gradient.

Furthermore, the inner contour of the passage can be continuous in a majority of sectional planes perpendicular to the longitudinal axis, in particular in all of its sectional planes perpendicular to the longitudinal axis. The inner contour of the passage in these sectional planes can be formed by non-concentric sections.

According to an embodiment, the non-circular shaped inner contour of the opening of the cap and/or the non-circular shaped outer contour of the neck is selected from the group of shape members consisting of an oval shape, an elliptical shape, a hyperbolic shape, and a triangle with rounded edges. In general, the non-circular contour preferably is symmetrical and/or does not form any sharp edges.

According to a further embodiment, a ratio of the width to height of the non-circular shaped inner contour of the opening in a plane transverse to the longitudinal axis of the receptacle is selected in the range of: 80-95% dependent on the diameter of the receptacle. In other words, a smallest diameter of the contour is between 0.8 to 0.95 times as long as a longest diameter of the contour.

According to an embodiment, the inner contour of the cap and the outer contour of the neck form a clearance fit when the cap attached onto the neck. In particular the inner contour of the cap is 0.5% to 2.0% larger than the outer contour of the neck. In other words, each inner diameter of the passage is 0.5%, to 2.0% larger than the respective outer diameter of the neck.

According to an embodiment, one or more seals are arranged between the neck and the cap for sealing between the neck and the cap when the cap is installed at the container. The seal is preferably arranged between an inner surface of the neck and the cap, in particular an inner support structure of the cap.

In order to be able to apply content of the container, e.g., a beauty product, more precisely, an applicator can be arranged at the cap. In this case, the seal can be arranged between an inner surface of the neck and a support structure for the applicator.

According to an embodiment, the receptacle further comprises a securing device, the securing device configured to provide at least one of an audible click and a tangible resistance when the cap is completely installed at the neck. This securing device can comprise an undulating surface, in particular a plurality of peaks separated by a plurality of valleys. Alternatively, or additionally, the securing device can comprise one or more domes. The securing device can be formed on the inner circumferential surface of the passage and the outer circumferential surface of the neck. The securing device can break through the general continuity of the inner and outer circumferential surfaces as long as they do not disturb the attach-ability of the cap onto the neck.

The container can have a material stored therein, with said material being a liquid, a paste, or a pourable solid material. In particular, said material can be selected from the group of members including: a beauty product, a cosmetic product, a cleaning product, a skin care product, a medical product, a dental product, a pharmaceutical product, an adhesive, a paint, and a building material. In other words, the container is configured to hold at least one of said materials.

BRIEF DESCRIPTION OF THE DRAWINGS

Exemplary embodiments and functions of the present disclosure are described herein in conjunction with the following drawings, showing schematically.

DETAILED DESCRIPTION

Figure 1:
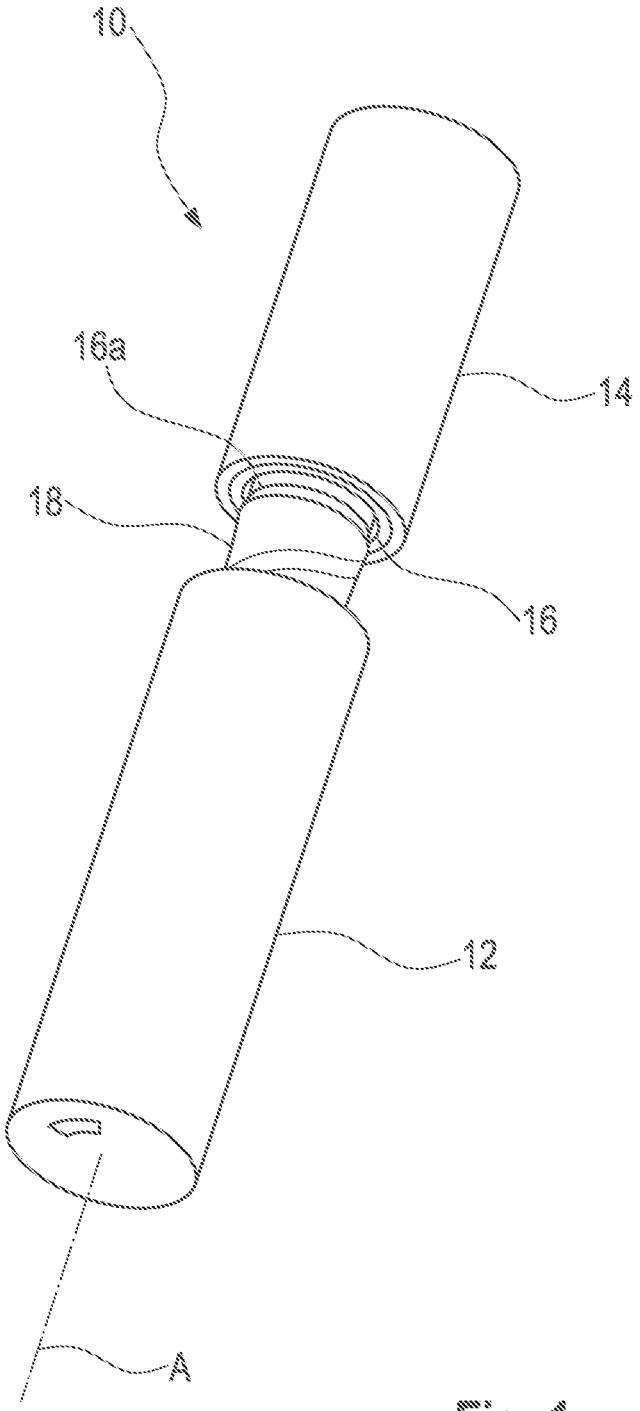
FIG. 1 is a perspective view of a receptacle according to the disclosure.

FIG. 1 depicts a receptacle 10 with a container 12 and a cap 14. The cap 14 is repeatedly attachable to the container 12 in order to close the receptacle 10. To attach the cap 14 to the container 12, the cap 14 has a passage 16 extending in a longitudinal axis A of the receptacle 10 with an opening 16*a* in one of its end regions. In other words, the cap 14 has a blind hole formed therein. The container 12 has a neck 18 that is configured to be inserted into the passage 16 via the opening 16*a*.

Figure 3A:
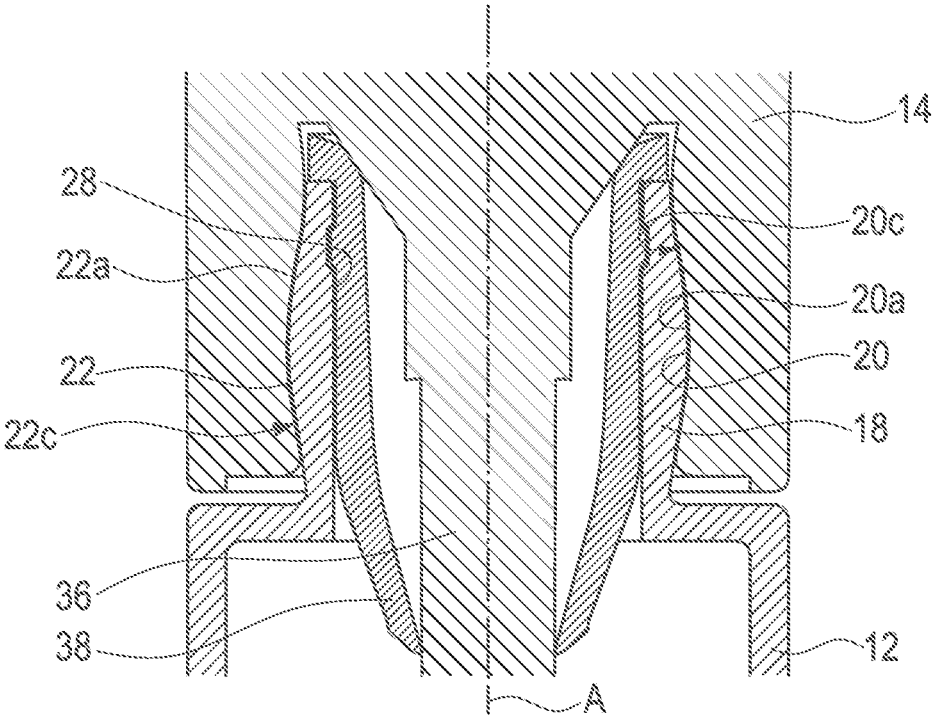
FIG. 3A illustrates a first sectional view of the interface of FIG. 2 in a first plane along a longitudinal axis of the receptacle.
Figure 3B:
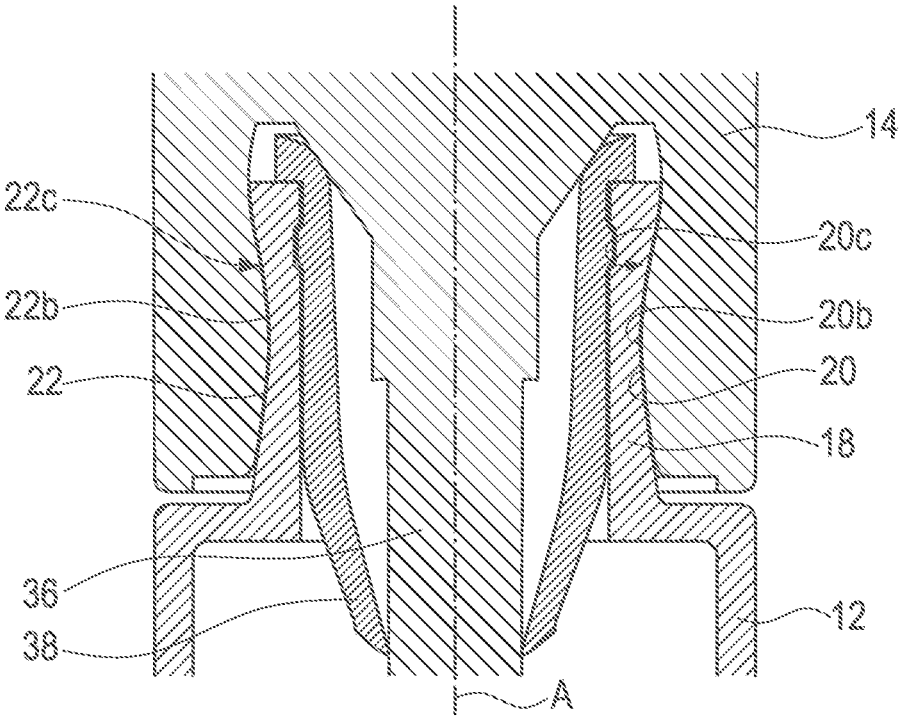
FIG. 3B illustrates a second sectional view of the interface of FIG. 2 along the longitudinal axis of the receptacle in a second plane perpendicular to the first plane shown in FIG. 3A.

As can be seen e.g., by comparing the sectional views of FIGS. 3A and 3B, the passage 16 has an inner circumferential shape along the longitudinal axis, i.e., an inner contour 20, that is non-circular shaped at least over a majority of the length of the passage 16, with the majority of the length being at least 51% preferably at least 80% of the length of the passage 16. The non-circular shaped inner contour 20 varies along the longitudinal axis so that points on the contour being equidistant to the longitudinal axis form a helix 21. In other words, the passage 16 has an inner circumferential surface that is formed as an inner circumferential surface of a twisted non-circular pipe.

Accordingly, the neck 18 has an outer circumferential shape along the longitudinal axis, an outer contour 22, that is non-circular shaped. The outer contour 22 is shaped complementary to the inner contour 20, to enable the cap 14 to be attached to the neck 18 by rotating the cap 14 relative to the container 12.

The non-circular shaped outer contour 22 varies along the longitudinal axis so that points on the contour being equidistant to the longitudinal axis A form a helix 23 (see FIG. 5B) having the same pitch or gradient as the helix 21 formed by the inner contour 20. In other words, the neck 18 has an outer circumferential surface that is formed as an outer circumferential surface of a twisted non-circular element.

Figure 2:
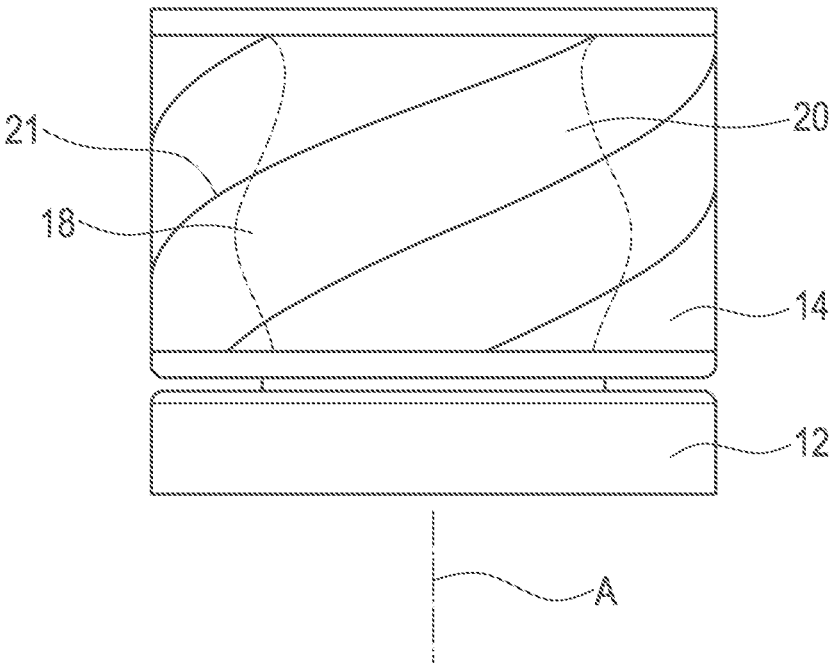
FIG. 2 is a detailed view of an interface between a container and a cap of the receptacle of FIG. 1.

As can be seen from FIGS. 2 and 3A, the outer contour 22 of the neck 18 has a convex outer surface 22*a* and the inner contour 20 of the cap 14 in a fully attached state forms a corresponding concave surface 20*a*. In contrast hereto, as can be seen in FIG. 3B, in a second sectional view, the outer contour 22 of the neck 18 has a concave outer surface 22*b* and the inner contour 20 of the cap 14 in a fully attached state forms a corresponding convex surface 20*h*.

The outer contour 22 of the neck 18 comprises a surface which includes both the convex outer surface 22*a* and the concave outer surface 22*b*, with a relative position of the different shapes of the outer contour 22 varying both radially and axially relative to the longitudinal axis A to form an engagement surface 22*c* that interacts with the inner contour 20 of the cap 14 for attachment of the cap 14. The inner contour 20 has a correspondingly shaped counter engagement surface 20*c*.

The outer contour 22 of the neck 18 and the corresponding inner contour 20 of the cap 14 allow the cap 14 to be attached to the neck 18 creating a form-fitting engagement in the axial direction without having a classical thread present.

Figure 4A:
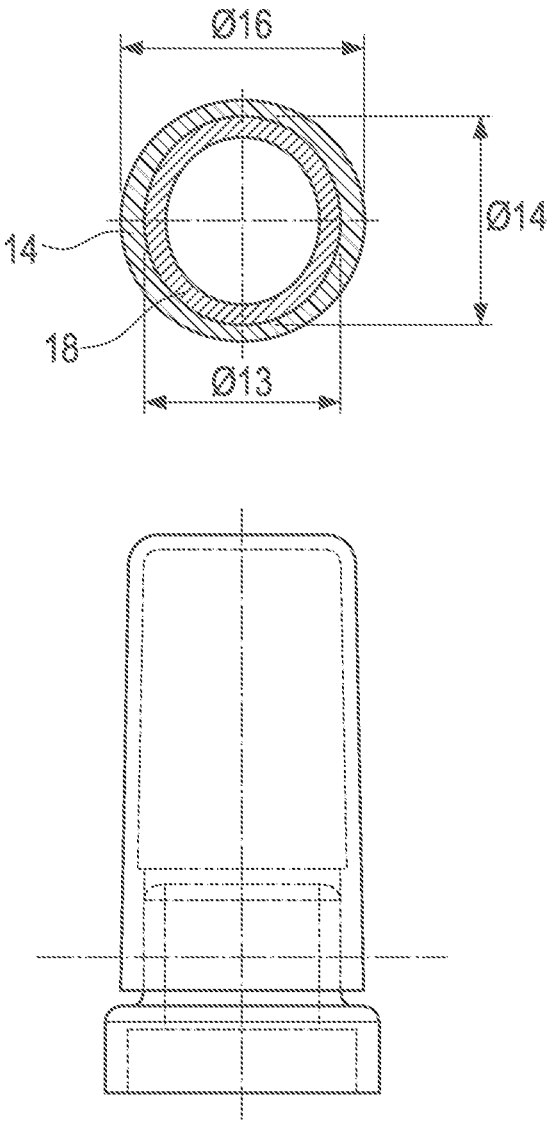
FIG. 4A illustrates a first state of a concept to generate a press-fitting engagement between the container and the cap.
Figure 4B:
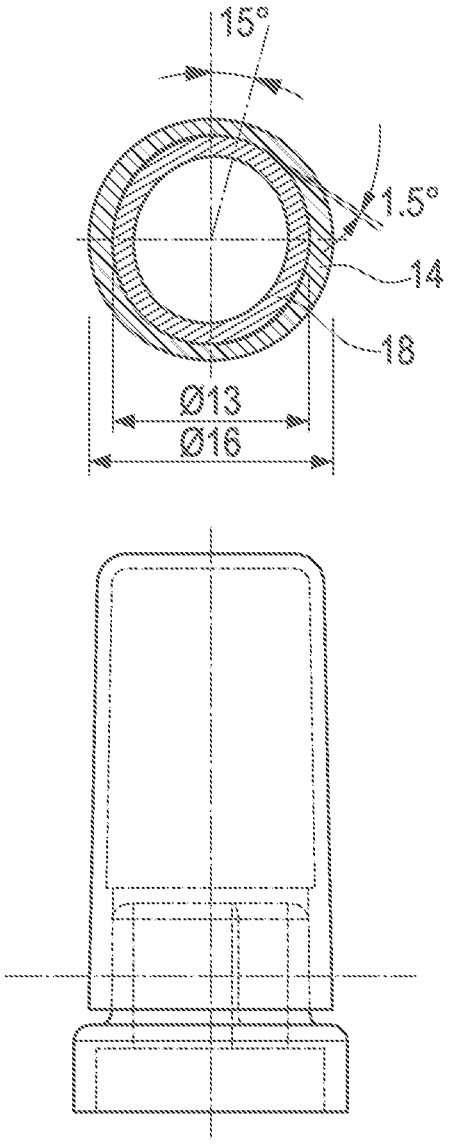
FIG. 4B illustrates a second state of the concept to generate a press-fitting engagement between the container and the cap.

Next, referring to FIGS. 4A and 4B, it is explained how a press-fitting engagement is generated after the cap 14 is fully attached to the neck 18. When the cap 14 is fully attached to the neck 18, the outer circumferential surface of the neck 18 and the inner circumferential surface of the cap 14 face each other with a constant distance (see FIG. 4A). In particular, since the outer circumference of the neck 18 and the inner circumference of the cap 14 are non-circular, in this example they are oval, the largest outer diameter of the neck 18 matches the largest inner diameter of the cap 14 regarding its angular orientation and the smallest outer diameter of the neck 18 matches the smallest inner diameter of the cap 14 regarding its angular orientation. When the cap 14 is then rotated further relative to the neck 18, the largest outer diameter of the neck 18 is placed at an angular position where the inner diameter of the cap 14 is smaller than the largest outer diameter of the neck 18 (see FIG. 4B). Therefore, the cap 14 and the neck 18 form a press-fitting engagement with the force caused by the press-fitting engagement being directed generally in a radial direction.

Figure 5A:
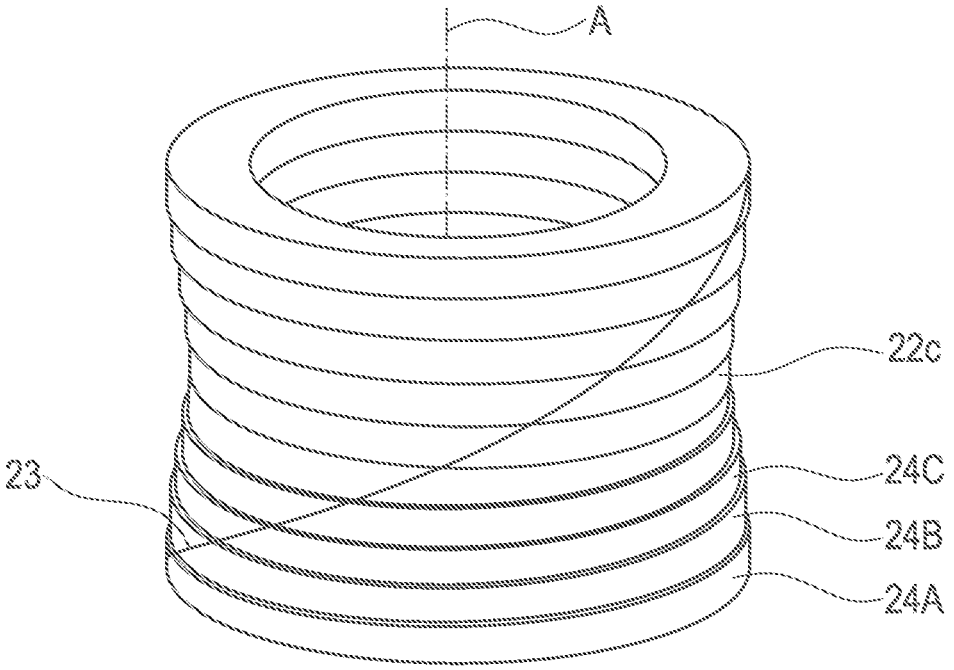
FIG. 5A illustrates a schematic representation to explain the outer shape of the neck.
Figure 5B:
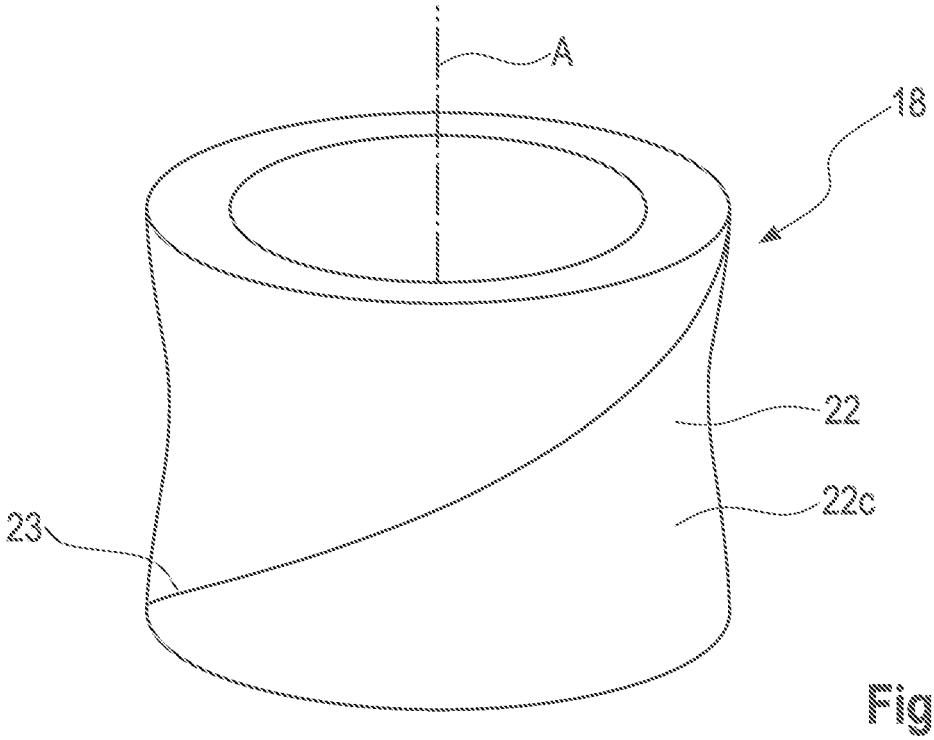
FIG. 5B illustrates a more detailed representation of the outer shape of the neck.
Figure 6A:
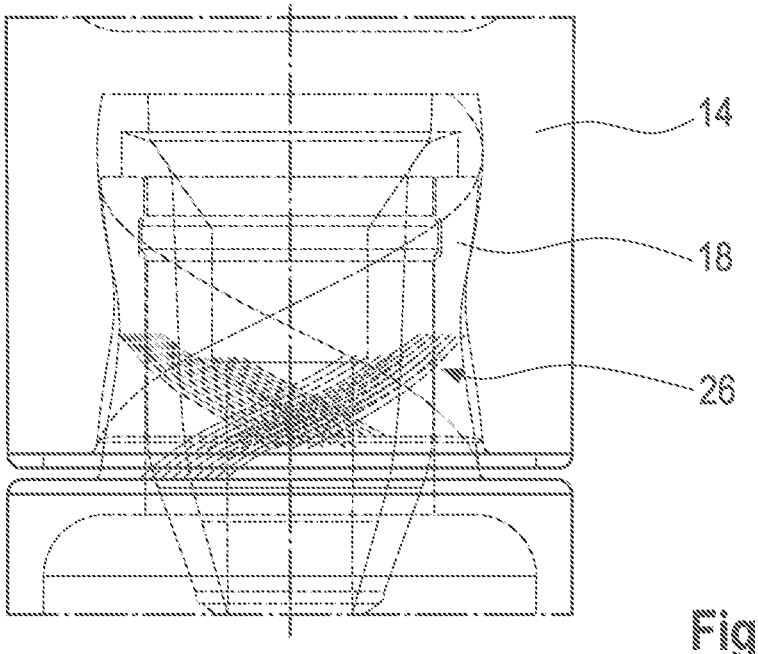
FIG. 6A illustrates a side view of the interface between the container and the cap if both objects were transparent showing multiple parallel lines that firm the securing device.
Figure 6B:
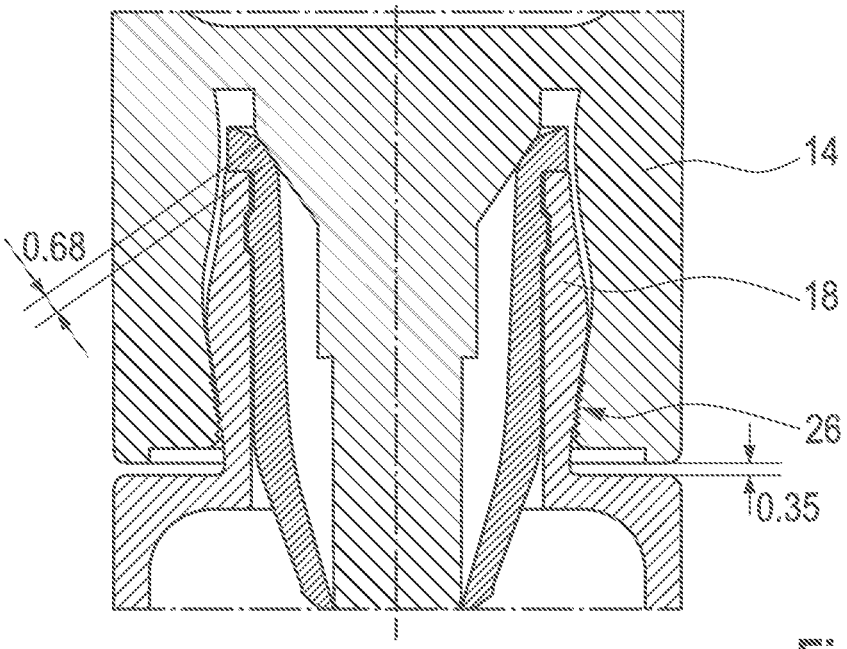
FIG. 6B illustrates a sectional view of the interface of FIG. 6A with multiple grooves formed on an inner circumferential surface of the cap that are represented by the lines in FIG. 6A.
Figure 7:
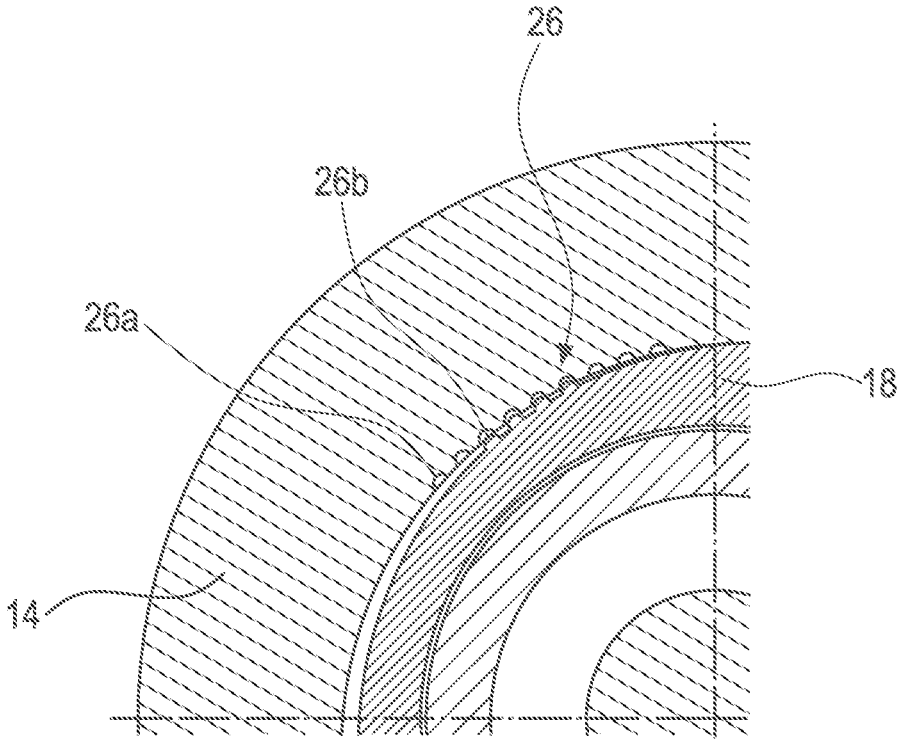
FIG. 7 illustrates a sectional view of the interface of FIG. 6A in a plane perpendicular to the longitudinal axis.

FIGS. 5A and 5B depict how the outer contour 22, i.e., the form of the engagement surface 22*c*, of the neck 18 is formed. FIG. 5A shows how the outer contour 22 would look like if manufactured out of different oval rings 24 with a certain thickness. A first oval ring 24A would be placed on the bottom. Next, a second, identical oval ring 24B would be placed on top of the first oval ring 24A but with an angular offset with respect to the longitudinal axis A. The next oval ring 24C is placed on the oval ring 24B with the same angular offset with respect to the longitudinal axis A and so on.

In order to create a continuous outer surface of the neck 18, as can be seen in FIG. 5B, the actual outer contour can be described thereby that oval rings 24 having an infinitesimal small thickness are placed on top of each other with a constant angular offset with respect to the longitudinal axis A and the previously and subsequently placed respective oval ring 24. In other words, the outer contour 22 of the neck can be described in that an angular position of each of the oval contours is controlled by a helix 23 that is arranged along the longitudinal axis A of the neck 18.

Alternatively, the continuous outer surface of the neck 18 can be described functional-ly as an ellipsoid 22 controlled by a helix 23 extending in the longitudinal direction A.

It is noted that the general shape of the rings 24 and therefore the contour 22 does not have to be oval, but could have other shapes as well. This results in a continuous outer surface with points being equidistant to the longitudinal axis A forming the helix 23.

The inner contour 20 of the cap 14 is formed 1*w* correspondingly shaped rings having an inner surface shaped complementary to the outer shape of the neck 18, depicted by the oval rings 24.

FIGS. 6A to 8 show a structure to form a securing device 26 that interrupts the continuity of the outer circumferential surface of the neck 18. The securing device 26 is formed by multiple parallel valleys or grooves 26*a* arranged at least substantially in parallel to one another or in parallel to one another that are formed on the inner circumferential surface of the cap 14 and a plurality of correspondingly shaped elevations or peaks 26*b* formed on the outer circumferential surface of the neck 18.

The securing device 26 is configured to provide multiple defined locking positions for the cap 14 relative to the neck 18 with each locking position providing an audible click and a tangible resistance when the cap is rotated into said locking position after the cap 14 is fully attached onto the neck 18.

It should be noted that also only one valley or groove 26*a* can be disposed at the inner contour 20 of the cap 14, with also only one correspondingly shaped elevation or peak 26*b* formed on the outer circumferential surface of the neck 18.

In this connection it should be noted that the securing device 26 can comprise one or more valleys or grooves 26*a* arranged at least substantially in parallel to one another or in parallel to one another at the inner circumferential surface of the cap 14.

It should further be noted that the securing device 26 can comprise one or more elevations or peaks 26*b* arranged at least substantially in parallel to one another or in parallel to one another the outer circumferential surface of the neck 18.

It should yet further be noted that the securing device 26 can be arranged at least substantially in parallel to at least one of the respective helices 21, 23.

Figure 12A:
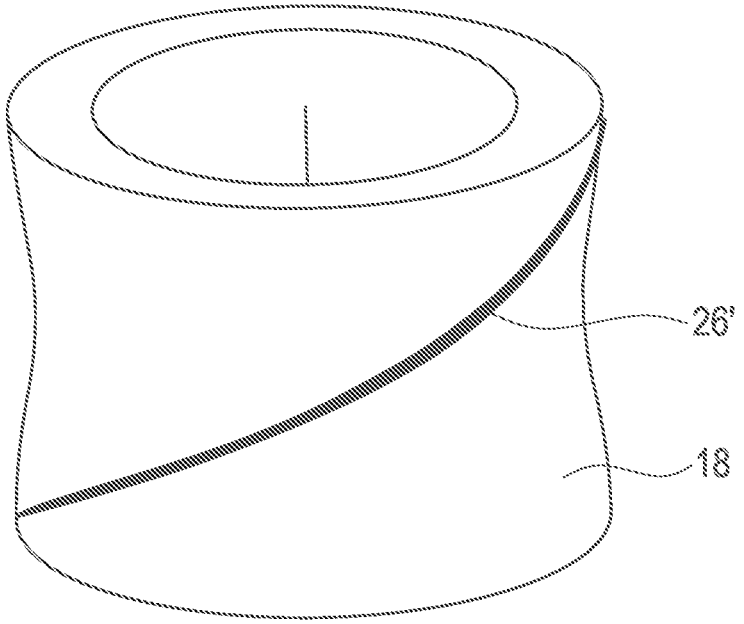
FIG. 12A illustrates a further embodiment of a securing device.

In FIG. 12A an embodiment of the securing device 26' is shown which comprises a groove or elevation that extends along a majority of the neck along a helix. On the inner circumferential surface of the cap 14, there is at least one corresponding elevation or groove to form a form-fitting engagement between the cap 14 and the neck 18.

Figure 12B:
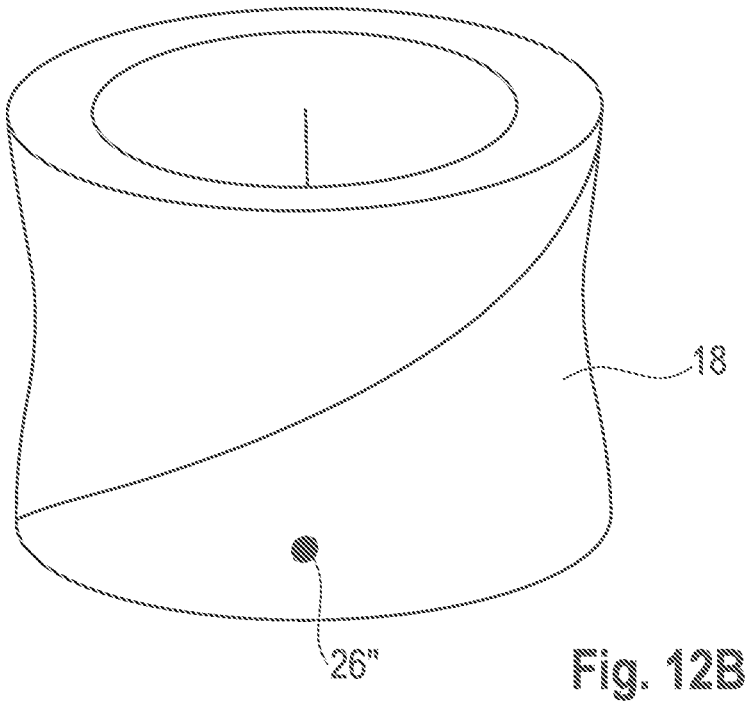
FIG. 12B illustrates another embodiment of a securing device.

Similarly, FIG. 12B shows a further embodiment of the securing device 26". In this embodiment, the securing device comprises a dome 26" or depression. Furthermore, the securing device 26" comprises a corresponding depression or dome on the inner circumferential surface of the cap 14. The dome 26" can be brought into engagement with the corresponding depression to form a form-fitting engagement to secure the cap 14 on the neck 18.

Figure 8:
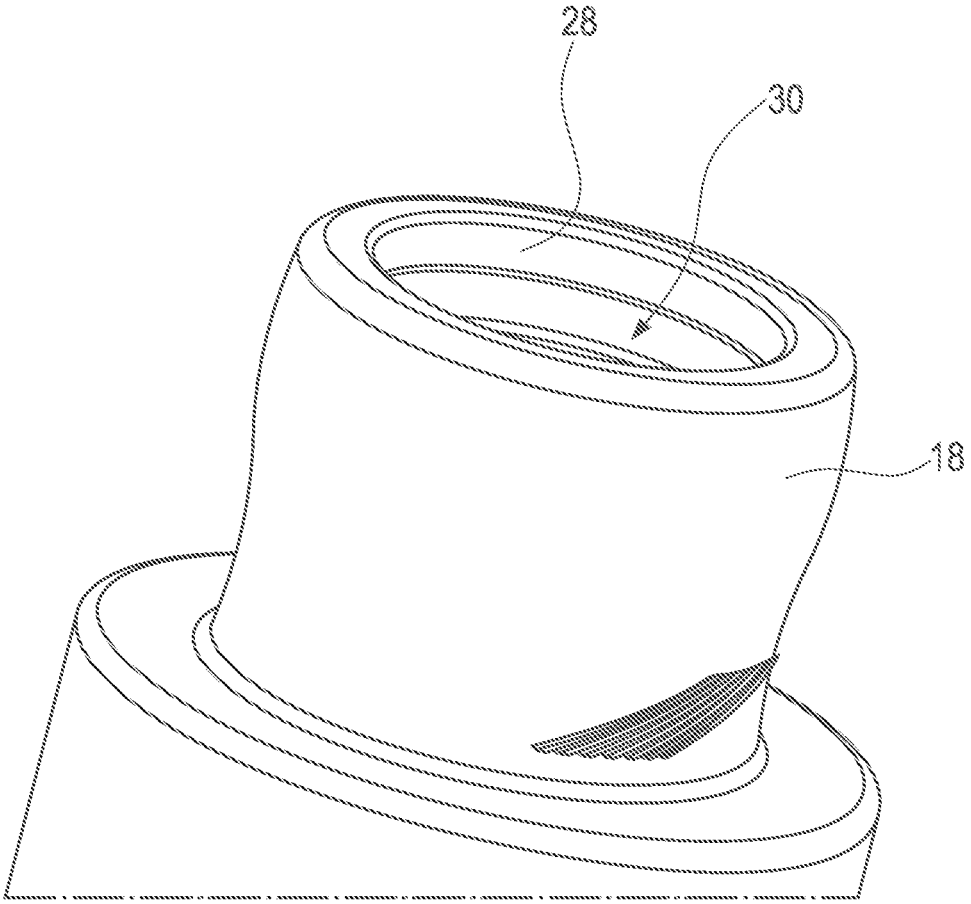
FIG. 8 illustrates a perspective view of a neck of a container according to a first embodiment.
Figure 9A:
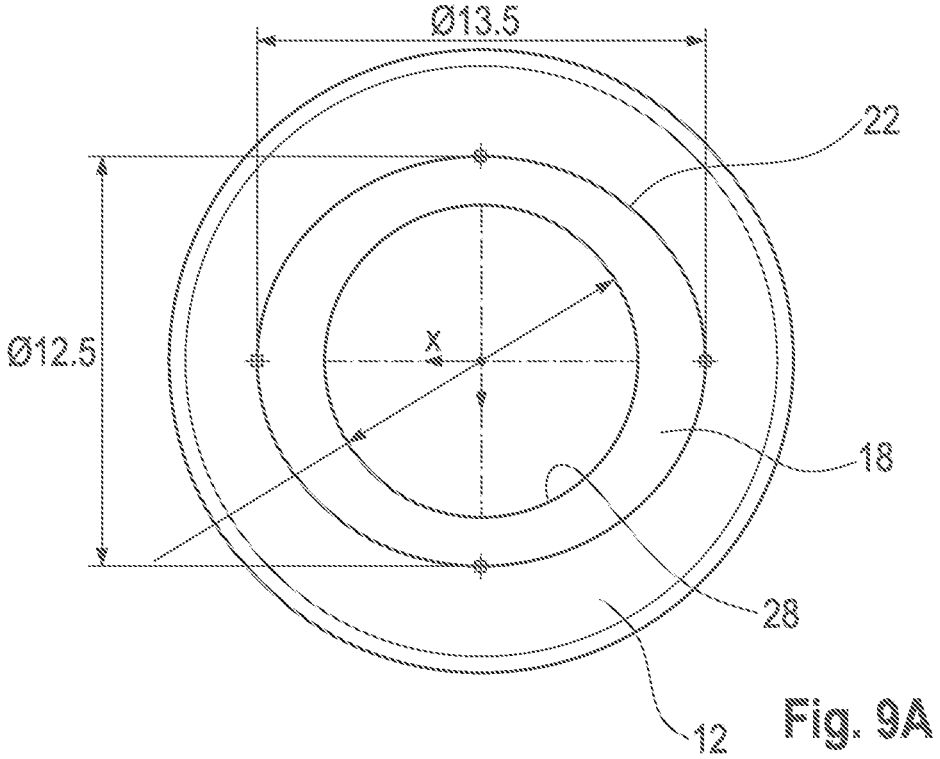
FIG. 9A illustrates a sectional view of the container of FIG. 8 in a plane perpendicular to the longitudinal axis.
Figure 9B:
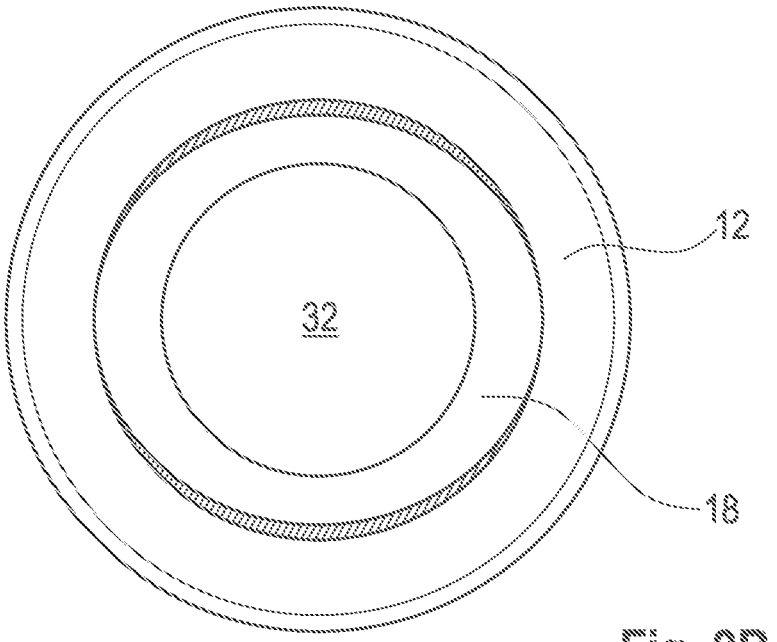
FIG. 9B illustrates a top view of the container of FIG. 8.

In FIGS. 8 to 9B, a first embodiment of the neck 18 is shown. As can be seen best in FIG. 9A, the outer circumferential surface or outer contour 22 has an oval cross-sectional shape. While the smallest diameter of the oval shape is 12.5 mm, the largest diameter of the oval shape is 13.5 mm. The measurements can vary depending on the size of the receptacle 10.

Generally speaking, the ratio between the smallest diameter of the oval shape and the largest diameter of the oval shape is selected in the range of 0.9 to 0.96, in particular 0.91 to 0.95, especially of 0.92 to 0.94. In particular, the ratio between the smallest diameter of the oval shape and the largest diameter of the oval shape can be 0.926.

The neck 18 also has an inner circumferential surface 28 which defines an inner cross-sectional shape which is a circular shape. The inner circumferential surface 28 defines a passage 30 that leads to a volume 32 (FIG. 9B) defined by the container 12 to store a product, e.g., a beauty product.

Figure 10:
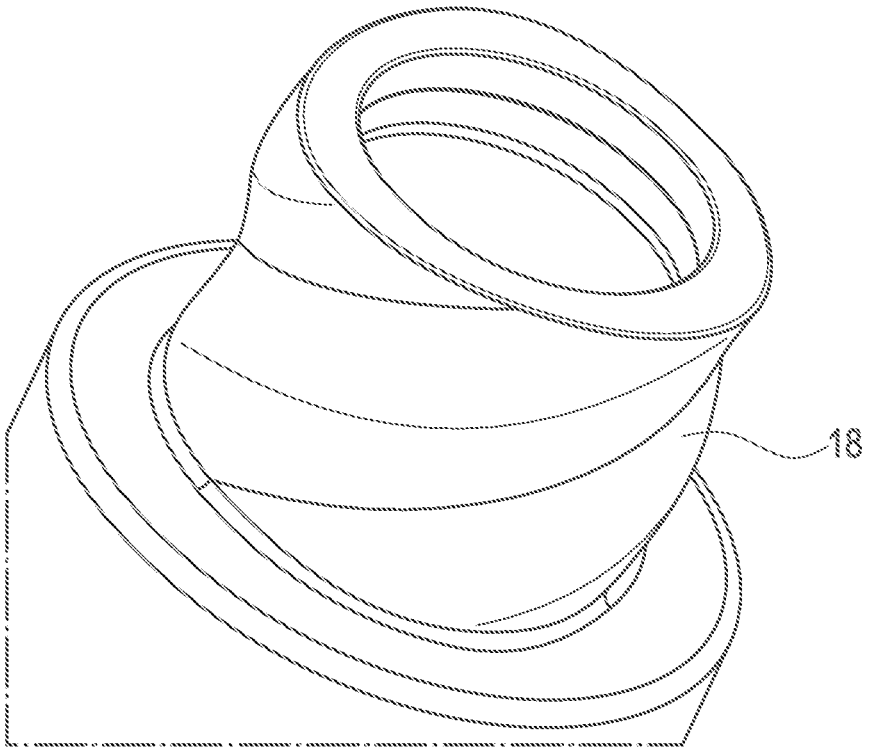
FIG. 10 illustrates a perspective view of a neck of a container according to a second embodiment.
Figure 11A:
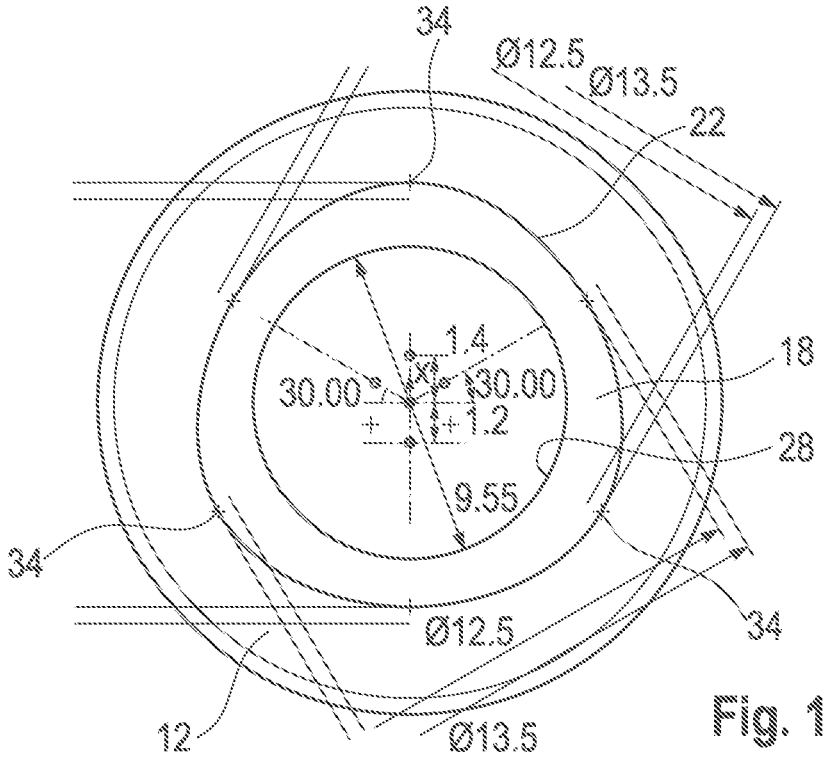
FIG. 11A illustrates a sectional view of the container of FIG. 10 in a plane perpendicular to the longitudinal axis.
Figure 11B:
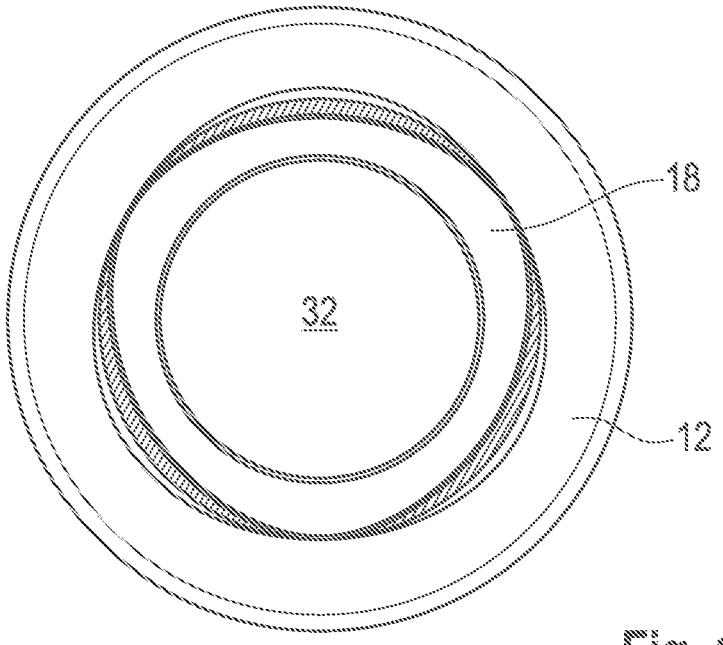
FIG. 11B illustrates a top view of the container of FIG. 10.

In FIGS. 10 to 11B, a second embodiment of the neck 18 is shown. As can be seen best in FIG. 11A, the outer circumferential surface has a cross-sectional shape that is-like the embodiment shown in FIGS. 8 to 9B—axially symmetrical, but—in contrast to the embodiment shown in FIGS. 8 to 9B—has 3 largest outer diameters 34. In particular, the shown neck 18 has a cross sectional shape in the form of a triangle with rounded edges. This embodiment has the advantage that the cap 14 can be placed on the neck 18 in three different angular positions each being 120° apart from each other making it easier to attach the cap 14 onto the neck 18.

As can be seen in FIGS. 3A and 3B, the cap 14 further comprises a support structure 36 for an applicator (not shown). The support structure 36 extends along the longitudinal axis A of the cap 14 and is partly surrounded by the caps inner circumferential surface. At the inner circumferential surface 28 of the neck 18, a sealing 38 is located. The sealing 38 is configured to seal against the support structure 36 when the cap 14 is attached to the neck 18 of the container 12.

On attaching the cap 14 to the neck 18, the convex shaped part of the of the engagement surface 22*c* engages the concave shaped part of the counter engagement surface 20*c*, similarly the concave shaped part of the engagement surface 22*c* engages the convex shaped part of the counter engagement surface 20*c*, and by rotating the cap 14 relative to the neck 18 to the cap is attached to the neck 18 of the container 12. On rotating the cap 14 relative to the container 12, the cap not only engages the neck 18 in a form fitting engagement, but also in a press-fitting engagement in a radial direction between the inner circumferential surface of the passage 16 and the outer circumferential surface of the neck 18 to secure the cap 14 at the container 12. Use of a common thread would produce a form-fitting engagement in the radial direction but no such press-fit.

The invention claimed is:

1. A receptacle comprising:

a container; and a cap, the cap being repeatedly attachable to the container to close the receptacle, the cap having a passage having an opening formed therein, the container having a neck configured to be inserted into the passage via the opening of the cap along a longitudinal axis of the receptacle, the opening of the cap having a non-circular shaped inner contour complementary to a non-circular shaped outer contour of the neck, an inner circumferential surface of the passage and an outer circumferential surface of the neck are configured so that a form-fitting engagement in the axial direction is generated by rotating the cap relative to the container around the longitudinal axis, and the inner circumferential surface of the passage and the outer circumferential surface of the neck are configured so that a press-fitting engagement in a radial direction between the inner circumferential surface of the passage and the outer circumferential surface of the neck is generated by rotating the cap relative to the container around the longitudinal axis by 5 degrees or more after the cap is in form-fitting engagement with the neck.

2. The receptacle according to claim 1, wherein the outer circumferential surface of the neck is an outer circumferential surface of a twisted non-circular element, and the inner circumferential surface of the passage is correspondingly formed as an inner circumferential surface of a twisted non-circular pipe so that the cap is capable of being attached onto the neck of the container by rotating the cap relative to the container.

3. The receptacle according to claim 2, wherein the outer circumferential surface of the neck is an outer circumferential surface of a non-circular element twisted about 180°;

and the inner circumferential surface of the passage is correspondingly an inner circumferential surface of a non-circular pipe twisted about 180° so that the cap is capable of being superimposed onto the neck of the container by rotating the cap relatively to the neck by about half of a turn.

4. The receptacle according to claim 1, wherein the inner circumferential surface of the passage and the outer circumferential surface of the neck are configured such that when rotating the cap relative to the container around the longitudinal axis, the cap is forced towards the container along the longitudinal axis.

5. The receptacle according to claim 1, wherein the outer contour of the neck along the longitudinal axis or a circumferential direction is continuous.

6. The receptacle according to claim 5, wherein a pitch of the contour of the neck along the longitudinal axis or a circumferential direction is continuous.

7. The receptacle according to claim 1, wherein the non-circular shaped inner contour of the opening of the cap or the non-circular shaped outer contour of the neck is selected from the group of shape members consisting of an oval shape, an elliptical shape and a triangle with rounded edges.

8. The receptacle according to claim 1, wherein the non-circular shaped inner contour of the opening of the cap in a plane transverse to the longitudinal axis of the receptacle has a smallest diameter between 0.8 to 0.95 times as long as a longest diameter of the contour.

9. The receptacle according to claim 1, wherein the inner contour of the cap and the outer contour of the neck form a clearance fit when the cap is superimposed onto the neck.

10. The receptacle according to claim 1, further comprising at least one seal arranged between the neck and the cap to seal between the neck and the cap when the cap is installed at the container, or comprising an applicator arranged at the cap.

11. The receptacle according to claim 10, wherein the at least one seal is arranged between an inner surface of the neck and the cap.

12. The receptacle according to claim 1, further comprising a securing device configured to provide at least one of an audible click and a tangible resistance when the cap is completely installed at the neck.

13. The receptacle according to claim 12, wherein the securing device comprises an undulating surface.

14. The receptacle according to claim 12, wherein the securing device comprises a plurality of peaks separated by a plurality of valleys.

15. The receptacle according to claim 1, further comprising a material stored therein, with the material being selected from the group of members consisting of: a beauty product, a cosmetic product, a cleaning product, a skin care product, a medical product, a dental product, a pharmaceutical product, an adhesive, a paint, and a building material.

16. The receptacle according to claim 1, wherein the inner contour of the cap is 0.5% to 2.0% larger than the outer contour of the neck.

17. The receptacle according to claim 1, wherein the passage defines a circumferential surface and the cap encloses the passage along the entire circumferential surface.

18. The receptacle according to claim 1, wherein the inner circumferential surface of the passage and the outer circumferential surface of the neck are configured so that the press-fitting engagement in the radial direction between the inner circumferential surface of the passage and the outer circumferential surface of the neck is generated by rotating the cap relative to the container around the longitudinal axis by up to 20 degrees after the cap is in form-fitting engagement with the neck.

19. A receptacle comprising:

a container; and a cap, the cap being repeatedly attachable to the container to close the receptacle, the cap having a passage having an opening formed therein, the container having a neck configured to be inserted into the passage via the opening of the cap along a longitudinal axis of the receptacle, the opening of the cap having a non-circular shaped inner contour complementary to a non-circular shaped outer contour of the neck, an outer circumferential surface of the neck is an outer circumferential surface of a twisted non-circular element twisted around the longitudinal axis in a first rotational direction, and an inner circumferential surface of the passage correspondingly configured as an inner circumferential surface of a twisted non-circular pipe twisted around the longitudinal axis in the same first rotational direction so that the cap is capable of being attached onto the neck of the container by rotating the cap relative to the container.

20. The receptacle according to claim 19, wherein the inner circumferential surface of the passage and the outer circumferential surface of the neck are configured so that a press-fitting engagement in a radial direction between the inner circumferential surface of the passage and the outer circumferential surface of the neck is generated by rotating the cap relative to the container around the longitudinal axis after the cap is attached onto the neck of the container.

21. The receptacle according to claim 20, wherein the press-fitting engagement between the inner circumferential surface of the passage and the outer circumferential surface of the neck is generated by rotating a non-circular shaped section of the cap relative to a complementary non-circular shaped section of the neck.

22. The receptacle according to claim 19, wherein the inner circumferential surface of the passage and the outer circumferential surface of the neck are configured such that when rotating the cap relative to the container around the longitudinal axis, the cap is forced towards the container along the longitudinal axis.

23. A receptacle comprising:

a container; and a cap, the cap being repeatedly attachable to the container to close the receptacle, the cap having a passage having an opening formed therein, the container having a neck configured to be inserted into the passage via the opening of the cap along a longitudinal axis of the receptacle, the opening of the cap having a non-circular shaped inner contour complementary to a non-circular shaped outer contour of the neck, an inner circumferential surface of the passage and an outer circumferential surface of the neck are configured so that a form-fitting engagement in the axial direction is generated by rotating the cap relative to the container around the longitudinal axis, and the inner circumferential surface of the passage and the outer circumferential surface of the neck are configured so that a press-fitting engagement in a radial direction between the inner circumferential surface of the passage and the outer circumferential surface of the neck is generated by rotating the cap relative to the container around the longitudinal axis after the cap is in form-fitting engagement with the neck to lock the cap in place relative to the container.

* * * * *